US007862158B2

(12) United States Patent
Fujii et al.

(10) Patent No.: US 7,862,158 B2
(45) Date of Patent: Jan. 4, 2011

(54) METHOD OF MANUFACTURING INK JET RECORDING HEAD, INK JET CARTRIDGE

(75) Inventors: Kenji Fujii, Kanagawa (JP); Shuji Koyama, Kanagawa (JP); Masaki Osumi, Kanagawa (JP); Shingo Nagata, Tokyo (JP); Jun Yamamuro, Kanagawa (JP); Yoshinori Tagawa, Kanagawa (JP); Hiroyuki Murayama, Kanagawa (JP); Yoshinobu Urayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 672 days.

(21) Appl. No.: 11/840,404

(22) Filed: Aug. 17, 2007

(65) Prior Publication Data

US 2007/0289942 A1 Dec. 20, 2007

Related U.S. Application Data

(62) Division of application No. 10/990,492, filed on Nov. 18, 2004, now Pat. No. 7,287,847.

(30) Foreign Application Priority Data

Nov. 28, 2003 (JP) ..... 2003-399219
Nov. 2, 2004 (JP) ..... 2004-319362

(51) Int. Cl.
*B41J 2/05* (2006.01)
*B41J 2/175* (2006.01)

(52) U.S. Cl. ..... 347/63; 347/65; 347/67; 347/93

(58) Field of Classification Search ..... None
See application file for complete search history.

(56) References Cited

U.S. PATENT DOCUMENTS 4,561,789 A 12/1985 Saito (Continued)

FOREIGN PATENT DOCUMENTS

FR 0 244 214 11/1987

(Continued)

OTHER PUBLICATIONS

Derwent-acc-No. 1985-058497 Jujikawa J.*

*Primary Examiner*—Duy-Vu N Deo
(74) *Attorney, Agent, or Firm*—Fitzpatrick, Cella, Harper & Scinto

(57) ABSTRACT

A method of manufacturing an ink jet head which discharges ink, comprising: a step of preparing a silicon substrate; a step of forming a membrane having a layer in which a plurality of holes are disposed to constitute a filter mask, and a layer with which a first surface is coated in such a manner that the first surface is not exposed from the plurality of holes on the first surface of the substrate; a step of forming a close contact enhancing layer on the membrane formed on the substrate; a step of forming a channel constituting member on the close contact enhancing layer to constitute a plurality of discharge ports and a plurality of ink channels communicating with the plurality of discharge ports; a step of forming an ink supply port communicating with the plurality of ink channels in the silicon substrate by anisotropic etching from a second surface facing the first surface of the substrate; and a step of forming a filter in a portion of the close contact enhancing layer positioned in an opening of the ink supply port using the layer of the membrane in which a plurality of holes are disposed as the mask.

4 Claims, 8 Drawing Sheets

U.S. PATENT DOCUMENTS

| | | | | |
|---|---|---|---|---|
| 5,124,717 | A | 6/1992 | Campanelli et al. | 347/93 |
| 5,154,815 | A * | 10/1992 | O'Neill | 205/75 |
| 5,478,606 | A | 12/1995 | Ohkuma et al. | |
| 5,940,957 | A | 8/1999 | Goto et al. | |
| 6,084,618 | A | 7/2000 | Baker | 347/93 |
| 6,139,761 | A | 10/2000 | Ohkuma | |
| 6,264,309 | B1 | 7/2001 | Sullivan | |
| 6,371,598 | B1 * | 4/2002 | Fujii et al. | 347/54 |
| 6,390,606 | B1 | 5/2002 | Terui et al. | |
| 6,543,884 | B1 | 4/2003 | Kawamura et al. | |
| 6,582,064 | B2 | 6/2003 | Cruz-Uribe et al. | |
| 6,685,299 | B2 | 2/2004 | Hirota | |
| 6,752,489 | B2 | 6/2004 | Ohashi et al. | |
| 6,814,435 | B1 | 11/2004 | Shimada et al. | 347/93 |
| 6,858,152 | B2 | 2/2005 | Koyama et al. | |
| RE38,710 | E | 3/2005 | Goto et al. | |
| 7,287,847 | B2 * | 10/2007 | Fujii et al. | 347/93 |
| 2002/0118255 | A1 | 8/2002 | Kanri | |
| 2003/0005883 | A1 | 1/2003 | Feinn et al. | |
| 2003/0080060 | A1 | 5/2003 | Gulvin | |
| 2003/0197763 | A1 | 10/2003 | Koyama et al. | |

FOREIGN PATENT DOCUMENTS

| | | |
|---|---|---|
| JP | 60-46264 | 3/1985 |
| JP | 6-023979 | 2/1994 |
| JP | 2000-94700 | 4/2000 |
| JP | 2002-326361 | 11/2002 |
| JP | 2002-355962 | 12/2002 |
| JP | 2003-19798 | 1/2003 |
| JP | 2003-145764 | 5/2003 |

* cited by examiner

METHOD OF MANUFACTURING INK JET RECORDING HEAD, INK JET CARTRIDGE

This is a divisional application of application Ser. No. 10/990,492, filed Nov. 18, 2004, now U.S. Pat. No. 7,287,847 now allowed.

BACKGROUND OF THE INVENTION

1. Field of the Invention

The present invention relates to a method of manufacturing an ink jet recording head for discharging liquid droplets to perform recording, an ink jet recording head, and an ink jet cartridge, concretely to a method of manufacturing an ink jet recording head comprising a filter, an ink jet recording head, and an ink jet cartridge.

2. Related Background Art

In recent years, to miniaturize an ink jet recording head, and raising a density of heads, a method has been proposed in which an electric control circuit for driving an ink discharge pressure generation element is built in a substrate using a semiconductor manufacturing technique. In order to supply ink to a plurality of discharge ports, the ink jet recording head is structured such that nozzles are passed through the substrate from the back surface of the substrate, and connected to a common ink supply port, and the ink is supplied to the respective nozzles from the common ink supply port. With regard to the recording head, a method described in U.S. Pat. No. 5,478,606 has been known as a method of manufacturing the head with a remarkably high precision, in which a distance between the ink discharge pressure generation element for discharging the ink from the discharge ports, and the discharge ports is reduced. When a silicon substrate is used as the substrate of the ink jet recording head, as described in U.S. Pat. No. 6,139,761, it is possible to form the ink supply port using an anisotropic etching technique.

As the reliability demanded for the ink jet recording head, dust and foreign matters are inhibited from being introduced into the nozzles. As a considered cause, the dust or foreign matters are mixed into the nozzles in the process of manufacturing the ink jet recording head, or the dust or foreign matters are sent together with the ink and enter the nozzles. As a countermeasure against this problem, it has been known that a filter is disposed on the ink jet recording head.

For example, in U.S. Pat. No. 6,264,309, it has been described that a resistance material layer for etching the ink supply port is disposed on the surface provided with a heater, and a plurality of holes are disposed in the resistance material layer to form the ink supply ports and also the filter in the recording head constituted of lamination of members for forming the discharge ports and channels with respect to the silicon substrate provided with the ink supply port. In U.S. Pat. No. 6,543,884, a constitution has been described in which individual ink supply ports are disposed for a plurality of ink jet chambers.

On the other hand, in Japanese Patent Application Laid-Open No. 2000-94700, it has been described that when the ink supply port is formed in the silicon substrate, a membrane filter is disposed simultaneously with the ink supply port using side etching with respect to an etching-proof mask disposed on a side opposite to a side on which a heater is disposed.

However, in the U.S. Pat. Nos. 6,264,309 and 6,543,884, there is a fear that the dust or foreign matters are mixed into the nozzles during lamination in the constitution in which the members for forming the discharge ports and channels are laminated with respect to the silicon substrate provided with the ink supply port. In the method in which the holes are disposed in the thin film on the silicon substrate constituting the filter before the ink supply port is formed in the silicon substrate as described in these documents, the ink supply port is formed in a state in which the holes are made in a layer for stopping anisotropic etching, described in the U.S. Pat. No. 6,139,761. Therefore, when the method described in the above-described document is to be applied to the method described in the U.S. Pat. No. 5,478,606, a soluble resin for forming the channels is immersed in an etching solution for forming the ink supply port, and there is a possibility that precision of the manufactured head, or yield of high-precision head manufacturing is adversely affected.

On the other hand, in the method of the Japanese Patent Application Laid-Open No. 2000-94700, an insulating film formed of $SiO_2$, SiN or the like is used as the etching-proof mask, but the insulating film (etching-proof mask) exposed on the back surface of the silicon substrate is usually constituted as a deposited film formed by sputtering or chemical vapor development. The film is exposed in various solutions in subsequently performed steps and corroded, or finely damaged during conveyance in a semiconductor manufacturing apparatus during a manufacturing process in some case. Therefore, it has been very difficult to keep the filter by the insulating film without any defect until a final product is manufactured.

SUMMARY OF THE INVENTION

The present invention has been developed in order to solve the above-described technical problem, and an object thereof is to provide a method of manufacturing an ink jet recording head, and the recording head, and an ink jet cartridge manufactured by the manufacturing method, in which a distance between an ink discharge pressure generation element and a discharge port is set with a remarkably high precision and in which discharge defects by foreign matters such as dust and the like generated during the manufacturing or using of the ink jet recording head are suppressed.

To achieve the above-described object, according to the present invention, there is provided a method of manufacturing an ink jet head, comprising: a step of preparing a silicon substrate; a step of forming a membrane having-a layer in which a plurality of holes are disposed to constitute a filter mask, and a layer with which a first surface is coated in such a manner that the first surface is not exposed from the plurality of holes on the first surface of the substrate; a step of forming a close contact enhancing layer on the membrane formed on the substrate; a step of forming a channel constituting member on the close contact enhancing layer to constitute a plurality of discharge ports and a plurality of ink channels communicating with the plurality of discharge ports; a step of forming an ink supply port communicating with the plurality of ink channels in the silicon substrate by anisotropic etching from a second surface facing the first surface of the substrate; and a step of forming a filter in a portion of the close contact enhancing layer positioned in an opening of the ink supply port using the layer of the membrane in which a plurality of holes are disposed as the mask.

In the above-described method of manufacturing the ink jet head, when the ink supply port is formed, the first surface is coated with the layer in such a manner that the first surface is not exposed from the plurality of holes disposed in the layer constituting a filter pattern, and therefore the ink channel does not communicate with the ink supply port. Therefore, even when the channel is formed by a mold by a resin, the resin forming the mold does not contact an etching solution of the anisotropic etching. Furthermore, the filter by the close contact enhancing layer can be formed on the surface of the substrate in which the ink channel is disposed in a state the ink channel is formed, and therefore it is not necessary to care about the mixing of the dust during the manufacturing by lamination. Since the filter is not exposed to the surface of the head chip even in a post step such as bonding to a chip plate, there is not any possibility that the filter is damaged by handling or the like. Therefore, there can be provided a method of manufacturing the ink jet recording head, which solve the above-described problem and which suppresses discharging defects by foreign matters such as dust and the like generated during the manufacturing or using of the ink jet recording head.

According to another aspect of the present invention, there is provided a method of manufacturing an ink jet head, comprising: a step of preparing a silicon substrate; a step of forming a first inorganic film on a first surface of the substrate; a step of forming a second inorganic film on the first inorganic film; a step of forming a close contact enhancing layer on the second inorganic film; a step of forming a channel constituting member on the close contact enhancing layer to constitute a plurality of discharge ports and a plurality of ink channels communicating with the plurality of discharge ports; a step of forming an ink supply port communicating with the plurality of ink channels in the silicon substrate by anisotropic etching from a second surface facing the first surface of the substrate; and a step of forming a plurality of holes constituting a filter in a portion of the close contact enhancing layer positioned in an opening of the ink supply port, wherein the step of disposing the ink supply port comprises: a step of blocking the communication of the ink channels with the ink supply port by one of the close contact enhancing layer and the second inorganic film, and allowing the ink channels to communicate with the ink supply port after forming the ink supply port.

Even in the method of manufacturing the ink jet head, one of the close contact enhancing layer and the second inorganic film blocks the communication of the ink channels with the ink supply port during the forming of the ink supply port. Therefore, even when the channels are formed by a mold by a resin, the resin forming the mold does not contact an etching solution of the anisotropic etching. Furthermore, the filter by the close contact enhancing layer is formed in the surface of the substrate in which the ink channels are disposed in a state in which the ink channels are formed, and the filter is not exposed to the surface of a head chip. There can be provided a method of manufacturing the ink jet recording head, in which, additionally, the above-described problem is solved, and discharging defects by foreign matters such as dust and the like generated during the manufacturing or using of the ink jet recording head are suppressed.

Moreover, according to the present invention, there is provided an ink jet recording head, comprising: a silicon substrate comprising a plurality of energy generation elements for discharging ink, and an ink supply port for supplying the ink to the energy generation elements; a channel forming member for forming a plurality of discharge ports for discharging the ink, corresponding to the plurality of energy generation elements, and a plurality of ink channels allowing the plurality of ink discharge ports to communicate with the ink supply port; and a close contact enhancing layer constituted of an organic film formed between the channel forming member and the substrate, wherein a filter is formed by the close contact enhancing layer in an opening of the ink supply port on the side of the channel forming member.

The above-described ink jet recording head can be easily manufactured by the above-described manufacturing method. As a further preferable aspect, the channel forming member may be constituted to form the organic film in a region of a part of the opening of the liquid supply port. Accordingly, for example, when a liquid flows into a liquid channel from the liquid supply port with great force, a filter structure can be prevented from being pushed and broken by the liquid. Therefore, strength against physical breakage of the filter structure can be enhanced.

Moreover, the filter structure has a plurality of filter holes. Assuming that a diameter of the discharge port or the liquid channel whose diameter is smaller is A, and a diameter of the filter hole is B, the filter may be constituted in such a manner that a relation of $A \geqq B$ is established. When the diameter of the discharge port or the liquid channel has this relation with that of the filter hole, the foreign matters passed through the filter structure can be discharged to the outside through the discharge port, and therefore the discharge port and the liquid channel are not prevented from being clogged with the foreign matters.

Furthermore, according to the present invention, there is provided an ink jet cartridge comprising this recording head.

BRIEF DESCRIPTION OF THE DRAWINGS

FIG. 8A is a top plan view, FIG. 8B is a 8B-8B sectional view of FIG. 8A, and FIG. 8C is a 8C-8C sectional view of FIG. 8B; FIG. 9A is a top plan view, FIG. 9B is a 9B-9B sectional view of FIG. 9A, and FIG. 9C is a 9C-9C sectional view of FIG. 9B.

DETAILED DESCRIPTION OF THE PREFERRED EMBODIMENTS

Next, an embodiment of the present invention will be described with reference to the drawings.

Figure 1A:
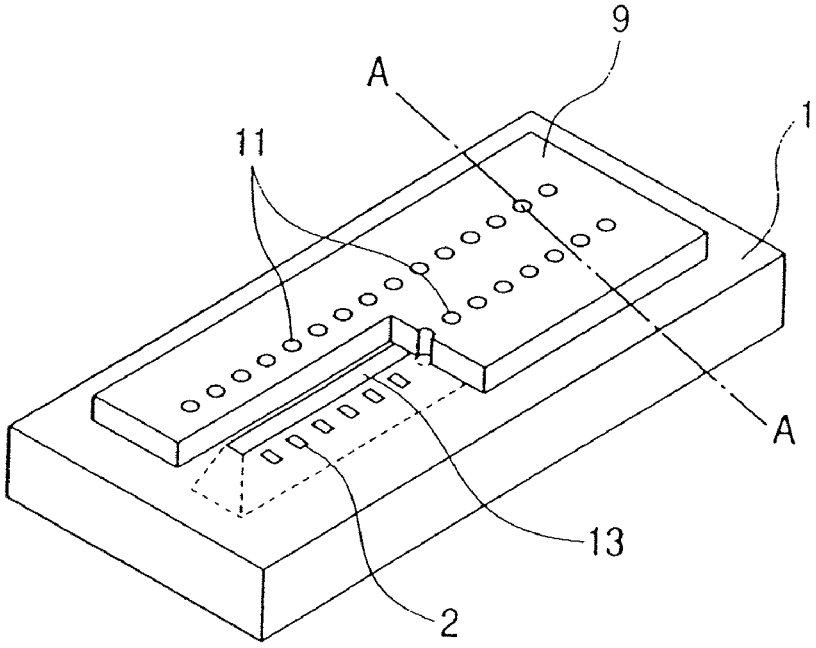
FIG. 1A is a schematic diagram showing an ink jet recording head according to one embodiment of the present invention.

FIG. 1A is a schematic diagram showing an ink jet recording head according to one embodiment of the present invention.

The ink jet recording head of the present embodiment has an Si substrate 1 on which ink discharge pressure generation elements (ink discharge energy generation elements) 2 are formed at a predetermined pitch in parallel in two rows. In the Si substrate 1, an ink supply port 13 formed by anisotropic etching of Si using an etching-proof mask 5 (see FIG. 2A) is opened between two rows of the ink discharge pressure generation elements 2. On the Si substrate 1, ink discharge ports 11 opening above the respective ink discharge pressure generation elements 2, and individual ink channels communicating with the respective ink discharge ports 11 from the ink supply port 13 are formed.

This ink jet recording head is disposed in such a manner that the surface in which the ink supply port 13 is formed faces a recording surface of a recording medium. In this ink jet recording head, pressure generated by the ink discharge pressure generation elements 2 is applied to ink charged in the ink channels via the ink supply port 13, accordingly the ink discharge ports 11 are allowed to discharge ink liquid droplets, and the droplets are attached to the recording medium to perform recording.

This ink jet recording head can be mounted on a printer, a copying machine, a facsimile machine, an apparatus such as a word processor having a printer section, and further an industrial recording apparatus combined with various processing devices in a compound manner. Moreover, when this ink jet recording head is used, the recording can be performed with respect to various recording mediums such as paper, thread, fiber, cloth, leather, metal, plastic, glass, wood, and ceramic. It is to be noted that in the present embodiment "recording" means that not only images having meanings, such as characters and diagrams, but also images having no meanings, such as patterns, are imparted to the recording mediums.

Figure 1B:
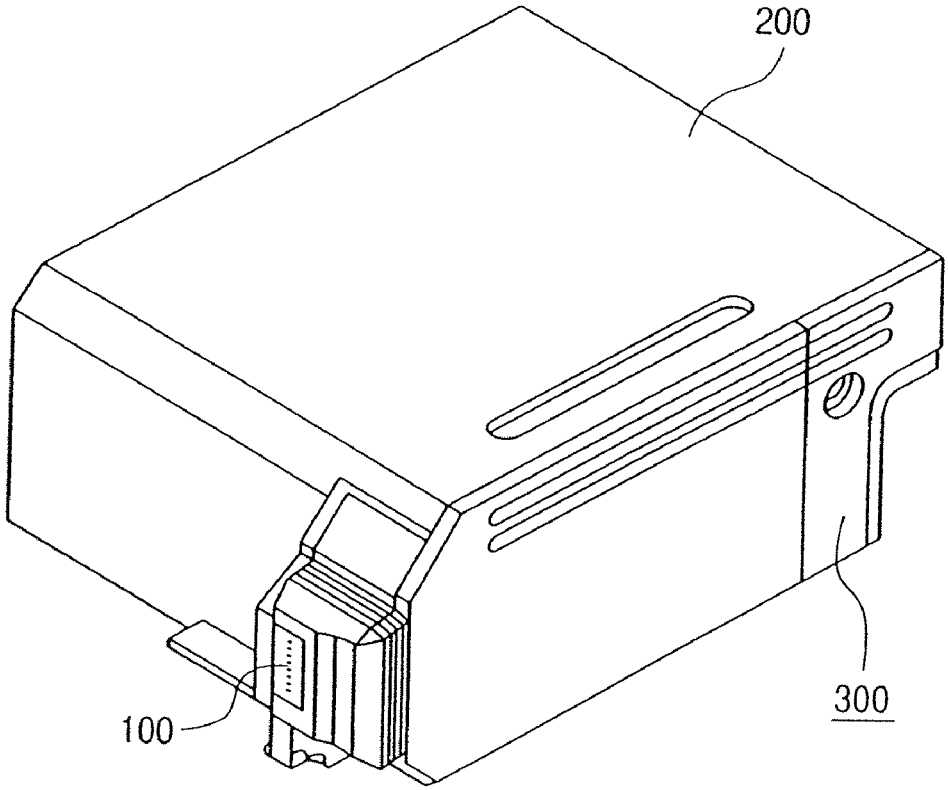
FIG. 1B is a perspective view showing one example of an ink jet cartridge to which the present invention is applicable.

Moreover, FIG. 1B is a perspective view showing one example of an ink jet cartridge to which the ink jet recording head shown in FIG. 1A is mounted. An ink jet cartridge 300 comprises the above-described ink jet recording head 100, and an ink storage section 200 which stores ink to be supplied to the ink jet recording head 100, and they are integrated.

First Example

Next, steps of manufacturing an ink jet recording head according to a first example of the present invention will be described with reference to FIGS. 2A to 2J. FIGS. 2A to 2J are schematic sectional views showing the steps of manufacturing the ink jet recording head according to the first example of the present invention. It is to be noted that FIGS. 2A to 2J show sections in A-A line of FIG. 1B.

Figure 2G:
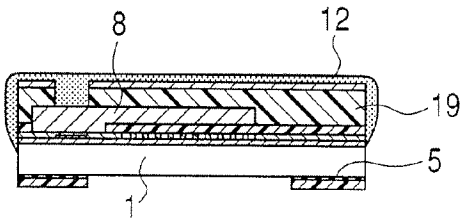
FIGS. 2A, 2B, 2C, 2D, 2E, 2F, 2G, 2H, 2I, and 2J are schematic sectional views showing steps of manufacturing the ink jet recording head according to a first example of the present invention in time series.
Figure 2H:
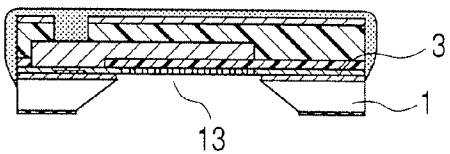
Figure 2I:
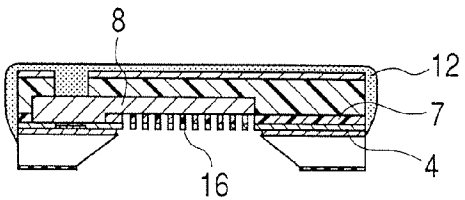
Figure 2J:
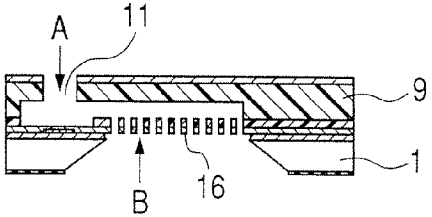
Figure 2A:
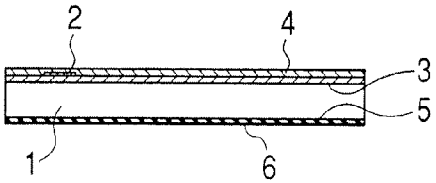

An Si substrate 1 shown in FIG. 2A has a crystal orientation of a <100> plane. In the present example, the Si substrate 1 having the crystal orientation of the <100> plane will be described as an example, but the plane orientation of the Si substrate 1 is not limited to this orientation.

An $SiO_2$ film 3 which was an insulating layer was formed on the surface (first surface) of the Si substrate 1, a plurality of ink discharge pressure generation elements 2 constituted of heat generating resistors and the like were constituted on the film, and further an electric signal circuit (not shown) was constituted. Furthermore, an SiN film 4 for use as a protective film for the ink discharge pressure generation elements 2 and the electric signal circuit was formed over the surface. As to thicknesses of these films 3, 4, the film thickness of the $SiO_2$ film 3 was set to 1.1 μm, and the film thickness of the SiN film 4 was set to 0.3 μm in order to secure a balance between discharge and accumulation of heat generated by the ink discharge pressure generation elements 2 and exert a function of the recording head. On the other hand, an etching-proof mask 5 and a polysilicon film 6 constituted of insulating films such as $SiO_2$ and SiN films were formed over the whole back surface (second surface) of the Si substrate 1.

Figure 2B:
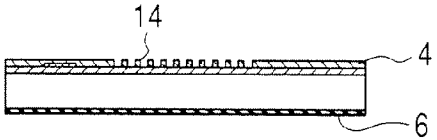

Next, a positive resist (not shown) was applied to the SiN film 4 on the surface of the Si substrate 1 by spin coating or the like, and thereafter dried. As shown in FIG. 2B, the positive resist was exposed and developed by ultraviolet rays, far ultraviolet rays (deep-UV) and the like. Subsequently, a positive resist pattern was used as a mask, the exposed SiN film 4 was dry-etched to form a filter pattern 14, and the positive resist was peeled.

Figure 2C:
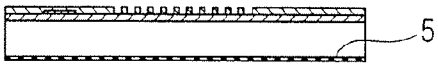

Next, as shown in FIG. 2C, the polysilicon film layer 6 on the back surface of the Si substrate 1 was all removed by dry etching and the like.

Figure 2D:
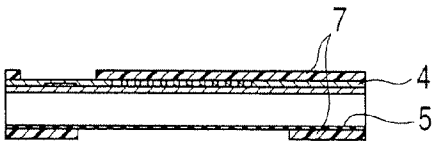

Next, as shown in FIG. 2D, polyether amide resin layers 7 were formed on the SiN film 4 on the front surface of the Si substrate 1, and etching-proof mask (insulating film) 5 on the back surface, and patterned in a predetermined manner. The polyether amide resin layers 7 are formed of thermoplastic resins. Since the polyether amide resin layers 7 fulfill a function of enhancing adhesion of a coating resin layer 9 constituting a nozzle forming member as described later, the polyether amide resin layers 7 will be referred to also as "adhesion enhancing layers". In the present example, thermoplastic polyether amide (trade name: HL-1200 manufactured by Hitachi Chemical Co., Ltd.) was used as a material of the close contact enhancing layer 7. This product has been on the market in a state of a solution obtained by dissolving thermoplastic polyether amide in a solvent. When thermoplastic polyether amide commercially available in this manner is applied onto the opposite surfaces of the Si substrate 1 by spin coating or the like, a positive resist (not shown) is further formed and patterned, and accordingly the close contact enhancing layer 7 can be formed as shown in FIG. 2D. In the present example, the film thickness of the close contact enhancing layer 7 was set to 2 μm.

Figure 2E:
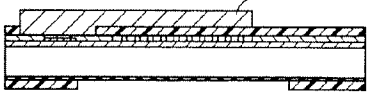

Next, as shown in FIG. 2E, a pattern layer 8 constituting an ink channel portion was formed of a soluble resin on the surface of the Si substrate 1 on which the ink discharge pressure generation elements 2 were constituted. As the soluble resin, for example, a deep-UV resist (trade name: ODUR manufactured by Tokyo Ohka Kogyo Co., Ltd.) is usable. This is applied onto the surface of the Si substrate 1 by the spin coating or the like, and thereafter exposed and developed by the deep-UV light to form the pattern layer 8.

Figure 2F:
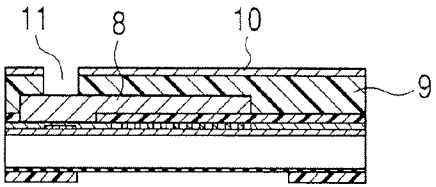

Next, as shown in FIG. 2F, the coating resin layer 9 formed of a photosensitive resin was formed on the pattern layer 8 by the spin coating or the like. Furthermore, a photosensitive water-repellent layer 10 formed of a dry film was disposed on the coating resin layer 9. Moreover, the coating resin layer 9 and the water-repellent layer 10 were exposed and developed by the ultraviolet rays, deep-UV light or the like to form an ink discharge port 11.

Next, as shown in FIG. 2G, the surface and side surfaces of the Si substrate 1 on which the pattern layer 8, the coating resin layer 9 and the like were patterned/formed were coated by a protective material 12 applied by the spin coating or the like. The protective material 12 is formed of a material which is capable of sufficiently resisting a strong alkali solution for use in anisotropically etching the Si substrate 1 in a subsequent step, and therefore the water-repellent layer 10 and the like can be prevented from being deteriorated during the anisotropic etching. The insulating film 5 on the back surface of the Si substrate 1 was wet-etched or treated otherwise using the polyether amide resin layer 7 as a mask, and accordingly patterned. Then, a starting surface for the anisotropic etching was exposed on the back surface of the Si substrate 1.

Next, as shown in FIG. 2H, an ink supply port 13 was formed in the Si substrate 1. The ink supply port 13 was formed, for example, by the anisotropic etching of the Si substrate 1 using strong alkali solutions such as tetramethyl ammonium hydroxide (TMAH) and potassium hydroxide (KOH). Thereafter, the polyether amide resin layer 7 on the back surface of the Si substrate 1 was removed by the dry etching or the like, and a portion positioned on the ink supply port 13 of the $SiO_2$ film 3 was removed by the wet etching. It is to be noted that burrs of the insulating film 5 generated on the periphery of an opening edge of the ink supply port 13 are removed during the wet etching of the $SiO_2$ film 3, the burrs generated on the insulating film 5 are prevented from being dropped as foreign matters.

Next, as shown in FIG. 2I, the close contact enhancing layer 7 was patterned from the back surface of the Si substrate 1 by the dry etching using the SiN film 4 as a mask. As a result, the close contact enhancing layer 7 was pattern in the same manner as in the filter pattern 14 formed on the SiN film 4 to constitute a filter 16 constituted of the SiN film 4 which was an inorganic film and the close contact enhancing layer 7 which was an organic film. It is to be noted that the SiN film 4 used as a mask material, if unnecessary, may be removed after the patterning of the close contact enhancing layer 7. In this case, the filter 16 is constituted only of the close contact enhancing layer 7 which is an organic film.

Next, as shown in FIG. 2J, the protective material 12 was removed. Furthermore, the material (thermoplastic resin) of the pattern layer 8 was eluted and removed through the ink discharge port 11 and the ink supply port 13, and accordingly an ink channel and a foam chamber were formed between the Si substrate 1 and the coating resin layer 9. As to the thermoplastic resin which is the material of the pattern layer 8, this thermoplastic resin is developed and softened by exposure of the whole surface of a wafer with the deep-UV light, and the wafer is ultrasonically immersed during the developing, if necessary, so that the resin can be eluted through the ink discharge port 11 and the ink supply port 13. Thereafter, the wafer is rotated at a high speed, a liquid for the ultrasonic immersion is blown off, and the insides of the ink channel and the foam chamber are dried.

Figure 3:
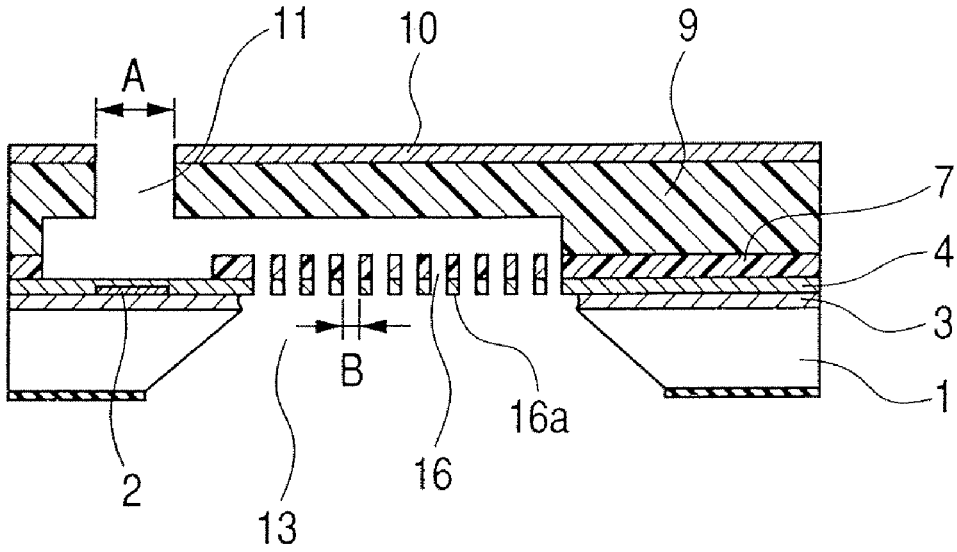
FIG. 3 is a sectional view showing an ink jet recording head according to the first example of the present invention.

The wafer in which a nozzle portion was formed by the above-described steps was separated/cut into chips with a dicing saw or the like, an electric wiring (not shown) or the like for driving the ink discharge pressure generation elements 2 was bonded to each chip, thereafter a chip tank member (not shown) storing ink to be supplied to the ink supply port 13 was connected to the ink supply port 13 of each chip, and an ink jet recording head was completed (see FIG. 3).

Filter holes 16*a* of the filter 16 has not only a function of the filter but also a function of a passage of the ink supplied to nozzles through the ink supply port 13 from a chip tank (not shown). To enhance a performance of the filter, a diameter of each filter hole 16*a* is set to be as small as possible, and the filter holes 16*a* are preferably arranged while setting an interval between the filter holes 16*a* to be as small as possible. On the other hand, however, when the filter holes 16*a* are formed in this manner, pressure loss (flow resistance) is caused, the ink does not flow smoothly, and an ink discharge speed is adversely affected. Therefore, it is not preferable to excessively reduce the diameters and the intervals of the filter holes 16*a*. Thus, a tradeoff relation is established between the performance and the flow resistance of the filter comprising the filter holes 16*a*.

Figure 4:
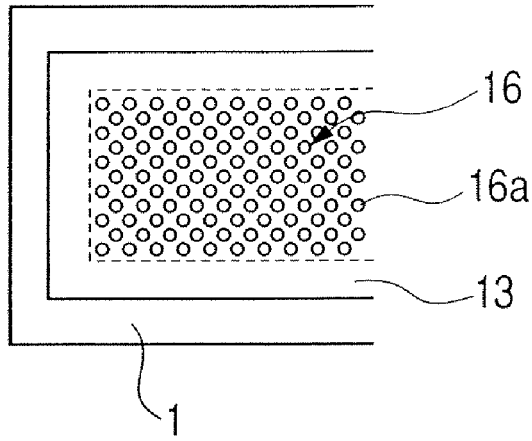
FIG. 4 is a schematic diagram showing a constitution of and around a filter constituted on the back surface of the ink jet head shown in FIG. 3.

FIG. 4 is a schematic diagram showing a constitution of and around the filter constituted on the back surface of the ink jet head shown in FIG. 3.

In the present example, the diameter of each filter hole 16*a* of the filter 16 was set to 6 μm, the interval between the adjacent filter holes 16*a* was set to 3 μm, and the filter holes were arranged at equal intervals. In the present example, the diameters and the intervals of the filter holes 16A were set in this manner. These dimensions are preferably set to be suitable for individual ink jet recording heads, that is, in such a manner as to establish the above-described tradeoff relation.

To prevent the ink discharge port 11 and the like from being clogged with foreign matters passed through the filter 16, in the constitution of the present example, assuming that a diameter of the discharge port 11 or the ink channel of the nozzle forming member 9 whose diameter is smaller (the diameter of the ink discharge port 11 in the constitution shown in FIG. 3) is A, and a diameter of the filter hole 16*a* is B, the filter has a relation of $A \geqq B$. When the diameter of the ink discharge port 11 or the ink channel and that of the filter hole 16*a* has this relation, the foreign matters passed through the filter 16 are passed through the ink channel and the ink discharge port 11 and discharged to the outside, and therefore the ink channel and the ink discharge port 11 are not clogged with the foreign matters.

Second Example

Next, steps of manufacturing an ink jet recording head according to a second example of the present invention will be described with reference to FIGS. 5A to 5J. FIGS. 5A to 5J are schematic sectional views showing the steps of manufacturing the ink jet recording head according to the second example of the present invention, and FIGS. 5A to 5J show sections in A-A line of FIG. 1B.

Figure 5G:
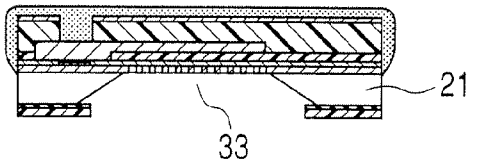
FIGS. 5A, 5B, 5C, 5D, 5E, 5F, 5G, 5H, 5I, and 5J are schematic sectional views showing steps of manufacturing the ink jet recording head according to a second example of the present invention in time series.
Figure 5H:
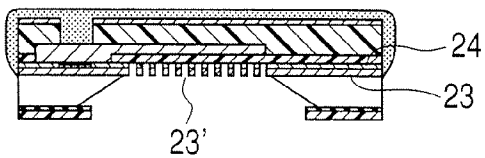
Figure 5I:
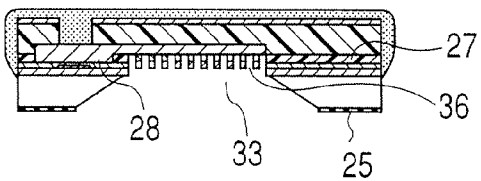
Figure 5J:
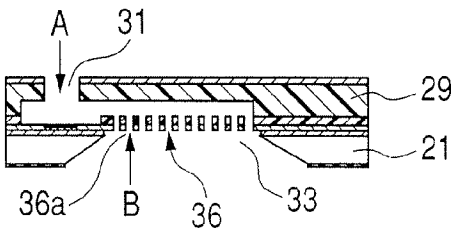
Figure 5A:
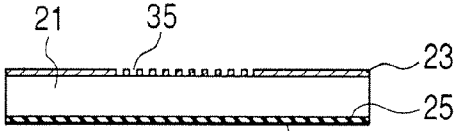

An Si substrate 21 shown in FIG. 5A has a crystal orientation of a <100> plane. Even in the present example, the Si substrate 21 having the crystal orientation of the <100> plane will be described as an example, but the plane orientation of the Si substrate 21 is not limited to this orientation.

An etching-proof mask 25 and a polysilicon film 26 constituted of insulating films such as $SiO_2$ and SiN films were formed over the whole back surface (second surface) of the Si substrate 21, and an $SiO_2$ film 23 was formed into a film thickness of 1.1 μm as an insulating layer on the surface (first surface) of the Si substrate 21.

As to the $SiO_2$ film 23, a positive resist (not shown) was applied by spin coating or the like, dried, and thereafter exposed and developed by ultraviolet rays, deep-UV light and the like. Subsequently, a positive resist pattern was used as a mask, the exposed SiN film 23 was removed by dry etching or the like, and the positive resist was peeled. The film can accordingly be patterned. In the present example, a pattern constituting a membrane filter structure 36 described later was formed on the $SiO_2$ film 23. A diameter and an interval of a filter hole was set to 6 μm and 3 μm, respectively, in the same manner as in the first example.

Figure 5B:
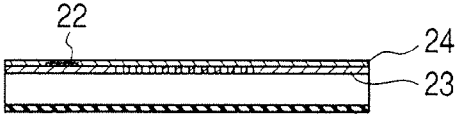

Next, as shown in FIG. 5B, a plurality of ink discharge pressure generation elements 22 constituted of heat generating resistors, and an electric signal circuit (not shown) were constituted on the $SiO_2$ film 23, and further, and an SiN film 24 for use as a protective film for the ink discharge pressure generation elements 22 and the electric signal circuit was formed over the whole surface. Thereafter, the polysilicon film 26 on the back surface of the Si substrate 21 was all removed by the dry etching or the like.

Figure 5C:
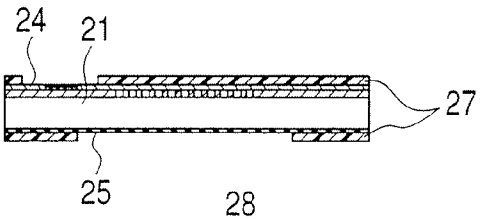

Next, as shown in FIG. 5C, polyether amide resin layers 27 were formed on the SiN film 24 on the front surface of the Si substrate 21 and the etching-proof mask (insulating film) 25 on the back surface, and patterned in a predetermined manner. In the present example, a film thickness of the close contact enhancing layer 27 was set to 2 μm.

Figure 5D:
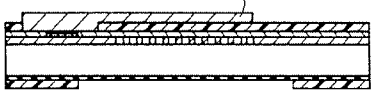

Next, as shown in FIG. 5D, a pattern layer 28 constituting an ink channel portion was formed of a soluble resin on the surface of the Si substrate 21 on which the ink discharge pressure generation elements 22 were constituted. As the soluble resin, for example, a deep-UV resist is usable. This is applied onto the surface of the Si substrate 21 by the spin coating or the like, and thereafter exposed and developed by the deep-UV light to form the pattern layer 28.

Figure 5E:
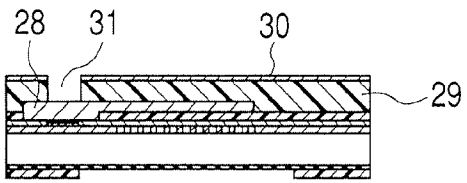

Next, as shown in FIG. 5E, a coating resin layer 29 formed of a photosensitive resin was formed on the pattern layer 28 by the spin coating or the like. Furthermore, a photosensitive water-repellent layer 30 formed of a dry film was disposed on the coating resin layer 29. Moreover, the coating resin layer 29 and the water-repellent layer 30 were exposed and developed by the ultraviolet rays, deep-UV light or the like to form an ink discharge port 31.

Figure 5F:
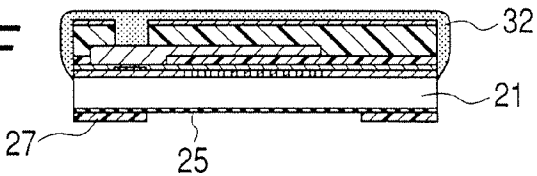

Next, as shown in FIG. 5F, the surface and side surfaces of the Si substrate 21 on which the pattern layer 28, the coating resin layer 29 and the like were patterned/formed were coated by a protective material 32 applied by the spin coating or the like. The protective material 32 is formed of a material which is capable of sufficiently resisting a strong alkali solution for use in anisotropic etching in a subsequent step, and therefore the water-repellent layer 30 and the like can be prevented from being deteriorated during the anisotropic etching. The insulating film 25 on the back surface of the Si substrate 21 was wet-etched or treated otherwise using the polyether amide resin layer 27 as a mask, and accordingly patterned. Then, a starting surface for the anisotropic etching was exposed on the back surface of the Si substrate 21.

Next, as shown in FIG. 5G, an ink supply port 33 was formed in the Si substrate 21. The ink supply port 33 was formed, for example, by the anisotropic etching of the Si substrate 21 using strong alkali solutions such as tetramethyl ammonium hydroxide (TMAH) and potassium hydroxide (KOH).

Next, as shown in FIG. 5H, the $SiO_2$ film 23 was used as a mask, and the SiN film 24 was patterned from the back surface of the Si substrate 21 by the dry etching. As a result, the SiN film 24 was patterned in the same manner as in a filter pattern 35 (see FIG. 5A).

Next, as shown in FIG. 5I, the close contact enhancing layer 27 was patterned from the back surface of the Si substrate 21 by the dry etching using the $SiO_2$ film 23 and SiN film 24 patterned as described above as masks. At this time, an $SiO_2$ film 23' (see FIG. 5H) attached to the surface of a portion of the SiN film 24 patterned into a filter pattern on the side of the ink supply port 33 was removed in the patterning step of the close contact enhancing layer 27. As a result, adhesion enhancing layer 27 was patterned in the same manner as in the filter pattern 35 to constitute the membrane filter structure 36 constituted of the SiN film 24 and the close contact enhancing layer 27. It is to be noted that the SiN film 24 used as a mask material, if unnecessary, may be removed after the patterning of the close contact enhancing layer 27. In this case, the membrane filter structure 36 is constituted only of the close contact enhancing layer 27 which is an organic film.

It is to be noted that burrs of the insulating film 25 generated on the periphery of an opening edge of the ink supply port 33 are removed together with the $SiO_2$ film 23' in the step of patterning the close contact enhancing layer 27, and therefore, unlike a conventional technique, the burrs generated on the insulating film 25 are prevented from being dropped as foreign matters.

Next, as shown in FIG. 5J, the protective material 32 was removed. Furthermore, the material (thermoplastic resin) of the pattern layer 28 was eluted through the ink discharge port 31 and the ink supply port 33, and accordingly an ink channel and a foam chamber were formed between the Si substrate 21 and the coating resin layer 29.

The Si substrate 21 in which a nozzle portion was formed by the above-described steps was separated/cut into chips with a dicing saw or the like, an electric wiring (not shown) or the like for driving the ink discharge pressure generation elements 22 was bonded to each chip, thereafter a chip tank member (not shown) storing ink to be supplied to the ink supply port 33 was connected to the ink supply port 33 of each chip, and an ink jet recording head was completed.

Even in the constitution of the present example, to prevent the ink discharge port 31 and the like from being clogged with foreign matters passed through the membrane filter structure 36, as shown in FIG. 5J, assuming that a diameter of the discharge port 31 or the ink channel of the nozzle forming member 29 whose diameter is smaller (the diameter of the ink discharge port 31 in the constitution shown in FIG. 5J) is A, and a diameter of the filter hole 36*a* is B, the structure has a relation of $A \geqq B$. When the diameter of the ink discharge port 31 or the ink channel and that of the filter hole 36*a* has this relation, the foreign matters passed through the membrane filter structure 36 are passed through the ink channel and the ink discharge port 31 and discharged to the outside, and therefore the ink channel and the ink discharge port 31 are not clogged with the foreign matters.

Third Example

Figure 6:
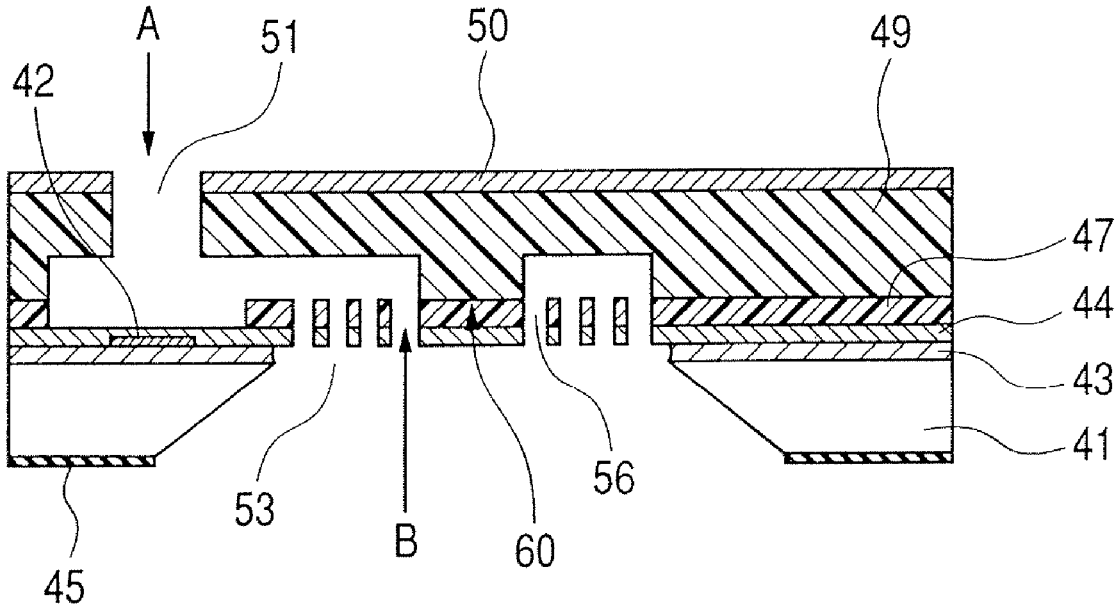
FIG. 6 is a sectional view showing the ink jet recording head according to a third example of the present invention.

FIG. 6 is a sectional view showing an ink jet recording head according to a third example of the present invention.

In the ink jet recording head of the present example, in a coating resin layer (nozzle forming member) 49 and a close contact enhancing layer 47 disposed on a first surface (upper surface) of an Si substrate 41, a portion existing in a middle area of an ink supply port 53 constitutes a support portion 60 which supports a membrane filter structure 56. The support portion 60 can be easily constituted by appropriately changing a shape of the pattern layer in the steps of manufacturing the ink jet recording head described in the first and second examples. Accordingly, for example, when ink flows into a nozzle channel from the ink supply port 53 with great force, the membrane filter structure 56 can be prevented from being pushed and broken by the ink. Therefore, strength of the membrane filter structure 56 against physical breakage can be enhanced.

It is to be noted that other constitutions of the ink jet recording head shown in FIG. 6 is similar to that shown in FIG. 3 and the like, and therefore detailed description thereof is omitted.

Moreover, even in the constitution of the present example, to prevent the ink discharge port 51 and the like from being clogged with foreign matters passed through the membrane filter structure 56, as shown in FIG. 6, assuming that a diameter of the discharge port 51 or the ink channel of the nozzle forming member 49 whose diameter is smaller (the diameter of the ink discharge port 51 in the constitution shown in FIG. 6) is A, and a diameter of the filter hole 56*a* is B, the structure has a relation of $A \geqq B$. When the diameter of the ink discharge port 51 or the ink channel and that of the filter hole 56*a* has this relation, the foreign matters passed through the membrane filter structure 56 are passed through the ink channel and the ink discharge port 51 and discharged to the outside, and therefore the ink channel and the ink discharge port 51 are not clogged with the foreign matters.

Fourth Example

Next, steps of manufacturing an ink jet recording head according to a fourth example of the present invention will be described with reference to FIGS. 7A to 7H. FIGS. 7A to 7H are schematic sectional views showing the steps of manufacturing the ink jet recording head according to the fourth example of the present invention, and FIGS. 7A to 7H show sections in A-A line of FIG. 1B.

The steps of manufacturing the ink jet recording head described above in the first and second examples are suitable for a case where a resin for use as a close contact enhancing layer does not have any photosensitive property. On the other hand, manufacturing steps of the present example are suitable for a case where the close contact enhancing layer is formed of a resin having the photosensitive property. The manufacturing method of the present example will be described hereinafter in comparison with the first example.

Figure 7A:
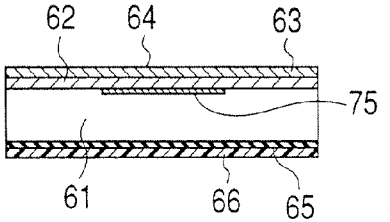
FIGS. 7A, 7B, 7C, 7D, 7E, 7F, 7G, and 7H are schematic sectional views showing steps of manufacturing the ink jet recording head according to a fourth example of the present invention in time series.

First, as shown in FIG. 7A, an Si substrate 61 having a crystal orientation of a <100> plane was prepared, and an $SiO_2$ film 63 which was an insulating layer was formed on the surface (first surface) of this substrate. On the film, an ink discharge pressure generation element 62 and an electric signal circuit (not shown) were constituted, and an SiN film 64 constituting a protective film for the element and circuit was formed over the whole surface. On the other hand, on the back surface (second surface) of the substrate, an etching-proof mask 65 and a polysilicon film 66 were formed over the whole surface. It is to be noted that a sacrificial layer 75 selectively etchable with respect to a substrate material is formed on the first surface of the Si substrate 61.

Figure 7B:
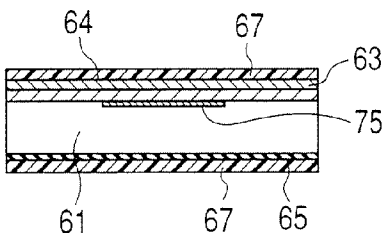
Figure 7C:
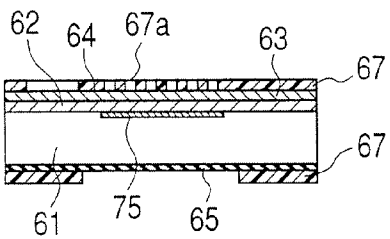

Next, as shown in FIG. 7B, after removing the polysilicon film 66 on the back surface of the substrate, resin layers 67 were formed on the front and back surfaces of the substrate. In the present example, the same material was used on the front and back surfaces of the substrate, but different materials may be used. Here, when a photosensitive resin material such as a photosensitive polyimide resin is used as the material of the resin layer 67 on the front surface of the substrate, as shown in FIG. 7C, a filter portion 67*a* can be easily formed by photolithography. The resin layer disposed on the back surface of the substrate also forms a pattern constituting a supply port opening in a known method.

Figure 7D:
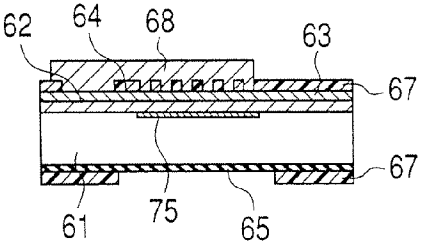
Figure 7E:
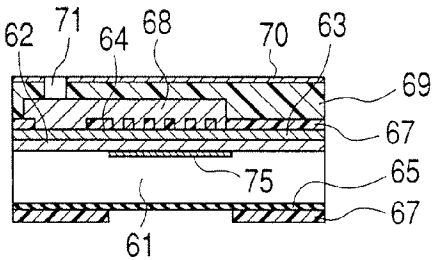
Figure 7F:
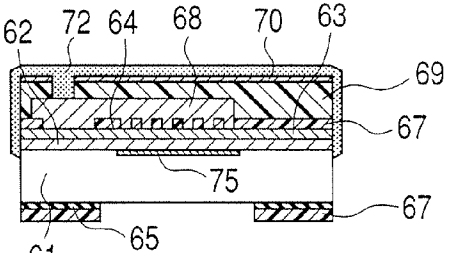

Next, as shown in FIG. 7D, a pattern layer 68 constituting an ink channel was formed. Moreover, as shown in FIG. 7E, a coating resin layer 69 formed of a photosensitive resin was formed on the layer, and a water-repellent layer 70 was disposed. Thereafter, an ink discharge port 71 was formed by patterning, and, as shown in FIG. 7F, members stacked on the first surface of the Si substrate were coated with a protective material 72. The etching-proof mask 65 was patterned using the resin layer 67 as a mask.

Figure 7G:
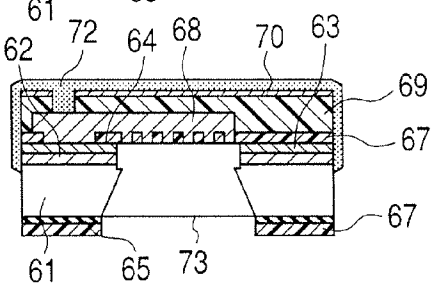
Figure 7H:
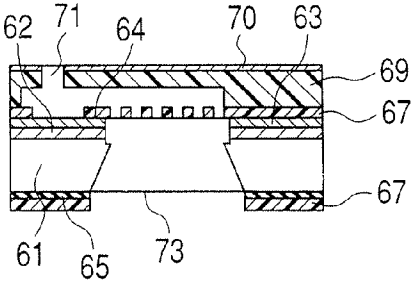

Thereafter, as shown in FIG. 7G, an ink supply port was formed by anisotropic etching using a strong alkali solution from the back surface of the Si substrate. Here, if the etching reaches the sacrificial layer, isotropic etching is started, but the $SiO_2$ film 63 and the SiN film are formed on the substrate front surface, and the pattern layer does not contact the alkali solution. Thereafter, the $SiO_2$ film 63 was removed by wet etching, the SiN film 64 was removed by dry etching, and then the filter 67*a* was exposed. Thereafter, the protective material 72 was removed, and the pattern layer 68 was removed to form an ink channel and a foam chamber. Therefore, steps similar to those of the first example were performed to complete the ink jet recording head.

Fifth Example

Figure 8A:
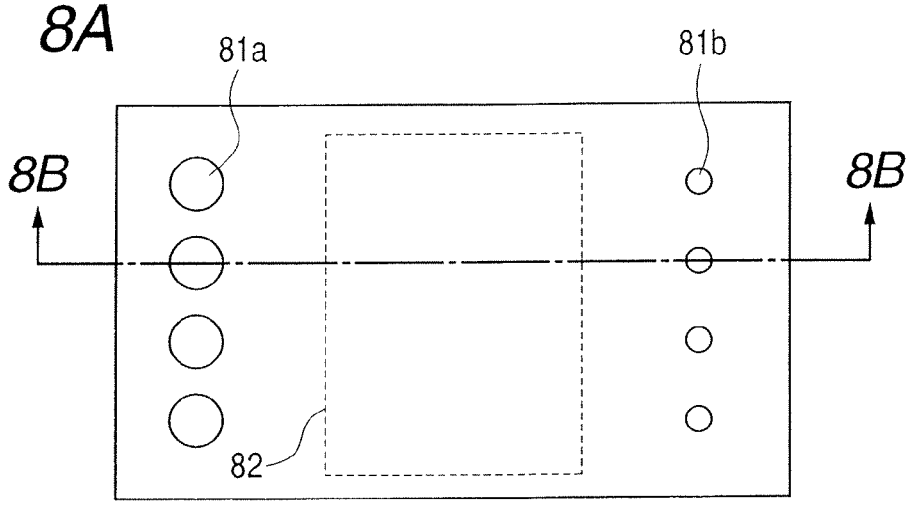
FIGS. 8A, 8B, and 8C are explanatory views of the ink jet recording head according to a fifth example of the present invention.
Figure 8B:
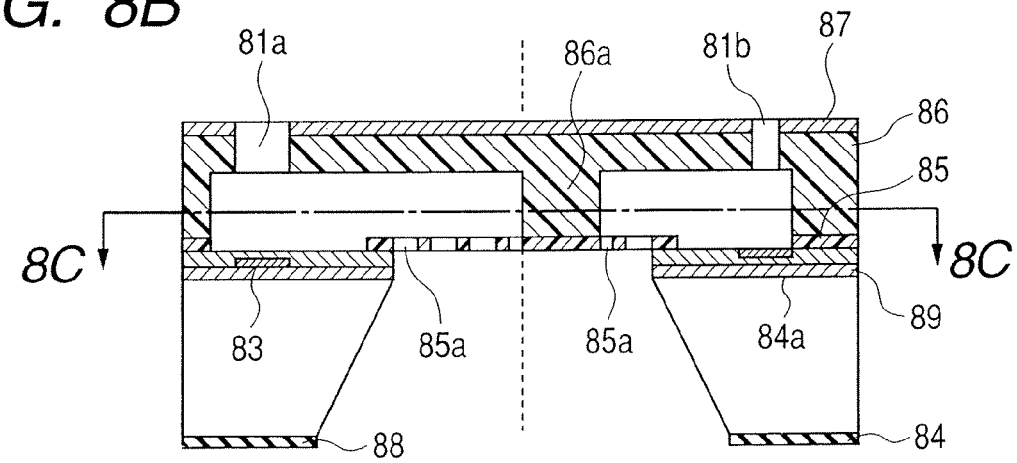
Figure 8C:
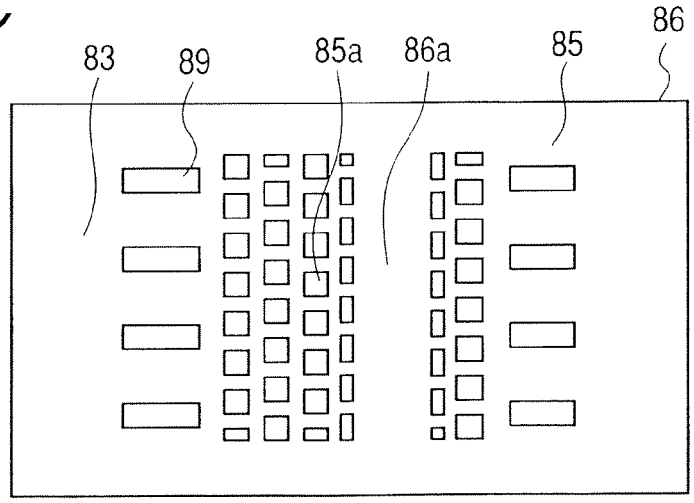

FIGS. 8A to 8C are sectional views showing an ink jet recording head according to a fifth example of the present invention. FIGS. 8A to 8C are explanatory views of the ink jet recording head according to the fifth example of the present invention, FIG. 8A is a top plan view, FIG. 8B is a 8B-8B sectional view of FIG. 8A, and FIG. 8C is a 8C-8C sectional view of FIG. 8B.

In the recording head of the present example, as shown in FIG. 8A, a first discharge port row constituted of first discharge ports 81*a* each having a predetermined discharge port diameter, and a second discharge port row constituted of second discharge ports 81*b* each having a discharge port diameter smaller than that of the first discharge port 81*a* are disposed in such a manner as to hold an ink supply port 82 therebetween. A liquid discharged from the first discharge port is more than that discharged from the second discharge port. In the present example, as apparent from FIGS. 8B and 8C, a close contact enhancing layer 85 forming a filter 85*a* was disposed over the first surface of an Si substrate 84 on which an $SiO_2$ film 84*a* and an SiN film excluding the vicinity of an ink discharge pressure generation element 83 of an ink channel. As in the third example, a support portion 86*a* for supporting the filter was disposed in a part of a coating resin layer (nozzle forming member) 86. Here, reference numeral 87 denotes a water-repellent layer, and 88 denotes an etching-proof mask layer.

In the present example, the filter 85*a* is partitioned on first and second discharge port row sides by the support portion 86*a*. Here, a filter for the first discharge port row has a filter aperture diameter equal to that of a filter for the second discharge port row, but the support member is disposed on the second discharge port row from a middle portion of the ink supply port, and therefore an area of the filter for the first discharge port row is larger than that of the filter for the second discharge port row.

In this case, ink can be supplied to the ink channel comprising the first discharge ports having a large liquid discharge amount without any ink supply shortage.

Sixth Example

Figure 9A:
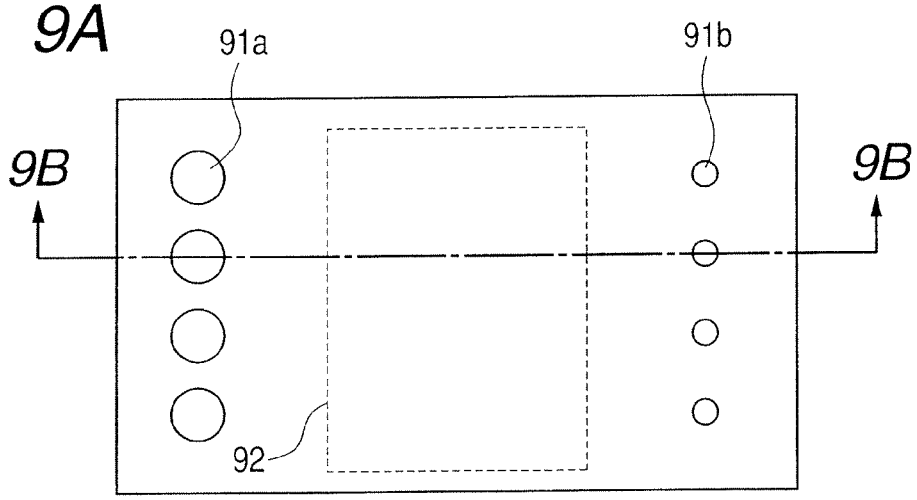
FIGS. 9A, 9B, and 9C are explanatory views of the ink jet recording head according to a sixth example of the present invention.
Figure 9B:
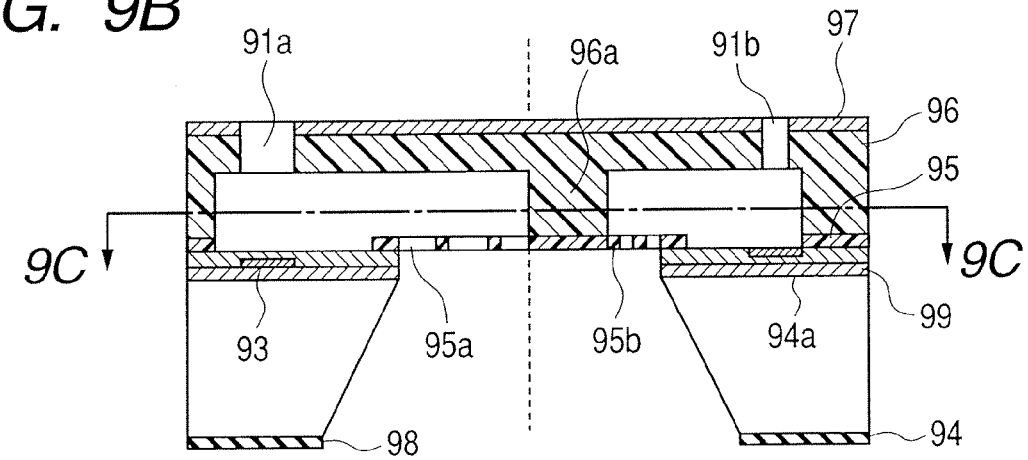
Figure 9C:
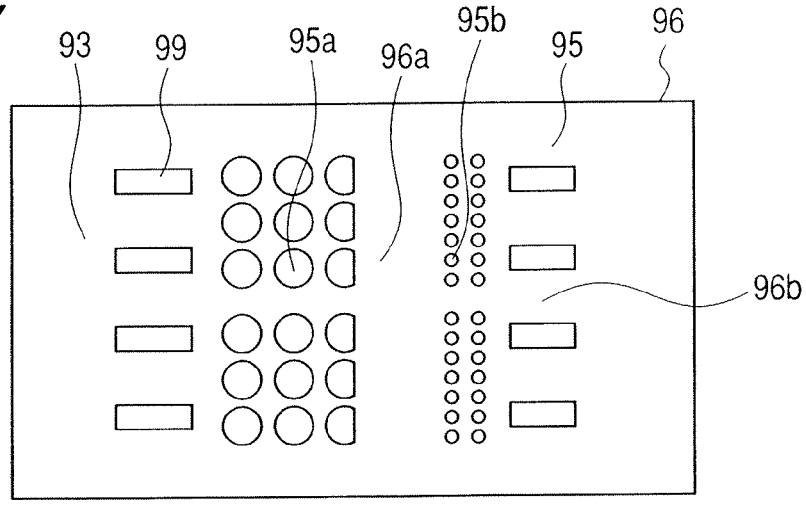

FIGS. 9A to 9C are sectional views showing an ink jet recording head according to a sixth example of the present invention. FIGS. 9A to 9C are explanatory views of the ink jet recording head according to the sixth example of the present invention, FIG. 9A is a top plan view, FIG. 9B is a 9B-9B sectional view of FIG. 9A, and FIG. 9C is a 9C-9C sectional view of FIG. 9B.

In the recording head of the present example, as shown in FIG. 9A, a first discharge port row constituted of first discharge ports 91*a* each having a predetermined discharge port diameter, and a second discharge port row constituted of second discharge ports 91*b* each having a discharge port diameter smaller than that of the first discharge port 91*a* are disposed in such a manner as to hold an ink supply port 92 therebetween. A liquid discharged from the first discharge port is more than that discharged from the second discharge port. In the present example, as apparent from FIGS. 9B and 9C, a close contact enhancing layer 95 forming a filter was disposed over the first surface of an Si substrate 94 on which an $SiO_2$ film 94*a* and an SiN film excluding the vicinity of an ink discharge pressure generation element 93 of an ink channel. As in the third example, a support portion 96*a* for supporting the filter was disposed in a part of a coating resin layer (nozzle forming member) 96. Here, reference numeral 97 denotes a water-repellent layer, and 98 denotes an etching-proof mask layer.

In the present example, the filter is partitioned into a filter 95*a* on the first discharge port row side, and a filter 95*b* on the second discharge port row side by the support portion 96*a*. Here, the filter 95*a* for the first discharge port row has a filter aperture diameter larger than that of the filter for the second discharge port row, and the filter for the first discharge port row also has a larger area.

In this case, ink can be supplied to the ink channel comprising the first discharge ports having a large liquid discharge amount without any ink supply shortage in the same manner as in the fifth example.

Moreover, in the present example, a protective member 96*b* is disposed in order to enhance a strength of the support portion 96*a*. In the present example, the protective member has a shape of the support portion continued to an ink channel wall, but is not limited to this shape.

This application claims priority from Japanese Patent Application Nos. 2003-399219 filed Nov. 28, 2003 and 2004-319362 filed Nov. 2, 2004, which are hereby incorporated by reference herein.

What is claimed is:

1. An ink jet recording head comprising:

a substrate provided at a first surface with a plurality of energy generation elements for generating energy for discharging ink, and an ink supply port, penetrating between the first surface and a second surface which is opposite the first surface, for supplying the ink to the energy generation elements;

a channel member for forming ink channels, allowing the ink supply port to communicate with ink discharge ports for discharging ink, the ink discharge ports corresponding to the plurality of energy generation elements; and an organic film layer formed from an organic film provided between the channel member and the first surface of the substrate, wherein stacked members comprising the organic film layer and another layer are provided at a position facing an opening of the ink supply port on a side of the first surface of the substrate and include a plurality of holes penetrating the organic film layer and the other layer so as to allow the supply port and the ink channels to communicate with one another.

2. The ink jet recording head according to claim 1, wherein the other layer is formed of an inorganic material.

3. The ink jet recording head according to claim 2, wherein the inorganic material is a silicon nitride.

4. An ink jet recording head comprising:

a substrate provided at a first surface with a plurality of energy generation elements for generating energy for discharging ink, and an ink supply port penetrating between the first surface and a second surface, which is opposite of the first surface, for supplying the ink to the energy generation elements;

a channel member for forming ink channels, allowing the ink supply port to communicate with ink discharge ports for discharging ink, the ink discharge ports corresponding to the plurality of energy generation elements; and a polyether amide resin layer formed from polyether amide resin and provided between the channel member and the first surface of the substrate, wherein polyether amide resin layer is provided at a position facing an opening of the ink supply port at a side of the first surface of the substrate and includes a plurality of holes penetrating the polyether amide resin layer so as to allow the supply port and the ink channels to communicate with one another.

* * * * *